US009440776B2

(12) United States Patent
Barenghi et al.

(10) Patent No.: US 9,440,776 B2
(45) Date of Patent: Sep. 13, 2016

(54) CONTAINER FOR DANGEROUS ENVIRONMENTS

(75) Inventors: Alfredo Barenghi, Milan (IT); Dario Colaut, Romans d'Isonzo (IT); Ettore Lattanzio, Settala (IT)

(73) Assignees: F.E.A.M. FORNTTURE ELETTRICHE APPARECCHIATURE MATERIALI S.R.L., Trezzano Sul Naviglio (MI) (IT); NUOVA A.S.P. ANTIDEFLAGRANTE STAGNO PETROLCHIMICA S.R.L., Pantigliate (MI) (IT)

( * ) Notice: Subject to any disclaimer, the term of this patent is extended or adjusted under 35 U.S.C. 154(b) by 0 days.

(21) Appl. No.: 13/257,437

(22) PCT Filed: Mar. 29, 2010

(86) PCT No.: PCT/EP2010/054076

§ 371 (c)(1),
(2), (4) Date: Nov. 4, 2011

(87) PCT Pub. No.: WO2010/112451

PCT Pub. Date: Oct. 7, 2010

(65) Prior Publication Data

US 2012/0043343 A1 Feb. 23, 2012

(30) Foreign Application Priority Data

Mar. 30, 2009 (IT) ..... MI2009A0499

(51) Int. Cl.

| | |
|---|---|
| ***B65D 43/16*** | (2006.01) |
| ***B65D 45/24*** | (2006.01) |
| *B65D 43/20* | (2006.01) |

(52) U.S. Cl.
CPC ..... *B65D 45/24* (2013.01); *B65D 2543/00518* (2013.01)

(58) Field of Classification Search
CPC ..... B65D 42/24; B65D 2543/00518
USPC ..... 220/813, 848, 327
See application file for complete search history.

(56) References Cited

U.S. PATENT DOCUMENTS

| | | | | |
|---|---|---|---|---|
| 911,137 | A * | 2/1909 | Lang | 220/283 |
| 1,399,759 | A * | 12/1921 | Fullenwider | 220/291 |

(Continued)

FOREIGN PATENT DOCUMENTS

| | | |
|---|---|---|
| EP | 1276361 | 1/2003 |
| WO | 00/62366 | 10/2000 |

*Primary Examiner* — J. Gregory Pickett
*Assistant Examiner* — Niki M Eloshway
(74) *Attorney, Agent, or Firm* — Lucas & Mercanti, LLP

(57) ABSTRACT

Container for dangerous environments, which comprises a base (1) and one or more side walls (2) joined to the base (1), so as to define an upper opening (3) which can be closed by a cover (4) and is surrounded by a first flange (5) provided with a plurality of first holes (6), while the cover (4) is provided with a second flange (7) provided with a plurality of second holes corresponding to the first holes (6) of the first flange (5), wherein the base (1), the side walls (2) and the first flange (5) are made of a single metal piece and the cover (4) is joined to the container by means of one or more hinges (10) which allow a rotating and translatory movement of the cover (4) with respect to the container, the cover (4) being provided with a perimetric frame (13) suitable for penetrating into the upper opening (3) and for being coupled with the upper portion of the inner surfaces of the side walls (2).

5 Claims, 2 Drawing Sheets

(56) References Cited

U.S. PATENT DOCUMENTS

| | | | | | |
|---|---|---|---|---|---|
| 1,598,135 | A | * | 8/1926 | Heinson et al. | 220/813 |
| 2,522,964 | A | * | 9/1950 | Rowe | H02B 1/38 220/813 |
| 2,681,165 | A | * | 6/1954 | Kornhauser et al. | 220/813 |
| 2,923,430 | A | * | 2/1960 | Stengele | 220/264 |
| 3,666,134 | A | * | 5/1972 | Rauch | E05B 65/006 174/50 |
| 4,091,958 | A | * | 5/1978 | Zemke | 220/291 |
| 4,696,412 | A | | 9/1987 | McGowan | |
| 5,219,007 | A | * | 6/1993 | Ebbing | 141/7 |
| 5,452,819 | A | * | 9/1995 | Vance | 220/303 |
| 6,085,935 | A | * | 7/2000 | Malchow et al. | 220/813 |
| 6,095,365 | A | * | 8/2000 | Yielding | 220/264 |
| 7,341,398 | B2 | * | 3/2008 | Johnson et al. | 404/25 |
| 7,658,570 | B2 | * | 2/2010 | Hill et al. | 404/25 |
| 7,695,213 | B1 | * | 4/2010 | Akkala et al. | 404/25 |
| 2002/0084275 | A1 | * | 7/2002 | Pysher et al. | 220/327 |
| 2005/0029881 | A1 | | 2/2005 | Preston | |
| 2008/0237252 | A1 | | 10/2008 | Elefante | |

* cited by examiner

CONTAINER FOR DANGEROUS ENVIRONMENTS

CROSS-REFERENCE TO RELATED APPLICATIONS

This application is a 371 of PCT/EP2010/054076 filed Mar. 29, 2010, which claims the benefit of Italian Patent Application No. MI2009A000499 filed Mar. 30, 2009, the contents of each of which are incorporated herein by reference.

FIELD OF THE INVENTION

The present invention relates to a container for dangerous environments, and in particular to a container which can house electric and/or electronic devices suitable for being used in potentially explosive atmospheres, due to the presence of combustible gases of the IIC group.

BACKGROUND OF THE INVENTION

Known containers for dangerous environments according to the IIC standard comprise a base and one or more side walls joined to the base, so as to define an upper opening which can be closed by a cover. The side walls are generally curved, so that it is hard to make lateral holes for the connection of the electric and/or electronic devices arranged in the container. Furthermore, the extension of the upper opening is smaller than the extension of the base, so that it is difficult to carry out the container in a single piece. For allowing the use in dangerous environments, the cover must ensure a particular seal, which is generally obtained with a threaded circular upper opening and a corresponding threaded cylindrical cover, which cause an increase of the manufacturing complexity of the container. Furthermore the threaded cover must rotate for closing the container, so that it is difficult or impossible to pass electric cables through the cover.

For overcoming said problem, US 2005/029881 and WO 00/62366 disclose a container comprising an upper opening surrounded by a first perforated flange and a cover provided with a second perforated flange for fastening these flanges by means of screws, wherein the base, the side walls and the first flange are made of a single metal piece.

U.S. Pat. No. 4,696,412 discloses a cover which is hinged to a container and is provided with a perimetric frame suitable for penetrating into the upper opening of the container and being coupled with the upper portion of the inner surfaces of the side walls. However, said frame ensures a relatively low seal, since it must be inclined and/or must have a reduced thickness, otherwise it would interfere with the upper edge of the container during the rotation by means of the hinges, thereby preventing the closing of the cover.

US 2008/237252 discloses safety hinges which allow a rotating and translatory movement of a cover with respect to a container for preventing the accidental crushing of fingers arranged between the cover and the container.

SUMMARY OF THE INVENTION

It is therefore an object of the present invention to provide a container which is free from said disadvantages, namely a container with an improved seal. Said object is achieved with a container, whose main features are disclosed in the first claim, while other features are disclosed in the remaining claims.

Thanks to the particular shape of the side walls and of the upper opening, the container according to the present invention can be provided with side openings and made in a single piece in a relatively simple manner.

Furthermore, the particular flanges and the particular perimetric frame of the cover ensure a suitable seal of the container, thereby allowing at the same time to keep the manufacturing costs low and to made openings for the cables also in the cover.

The cover is joined to the container by means of hinges which allow a rotating and translatory movement of the cover, so as to simplify the container opening and closing, especially with a relatively high perimetric frame which is perpendicular to the flange of the cover.

For further improving the seal of the container, the perimetric frame can be coupled with a perimetric seat made in the upper portion of the side walls and the outer surface of the perimetric frame is preferably perpendicular to the surface of the cover flange.

Particular threaded extractors are screwed in threaded holes which cross the second flange, so as to allow a perfect and smooth coupling between container and cover also with the minimal tolerances needed for improving the seal.

BRIEF DESCRIPTION OF DRAWINGS

Further advantages and features of the container according to the present invention will become clear to those skilled in the art from the following detailed and non-limiting description of an embodiment thereof with reference to the attached drawings, wherein.

DETAILED DESCRIPTION OF THE INVENTION

Figure 1:
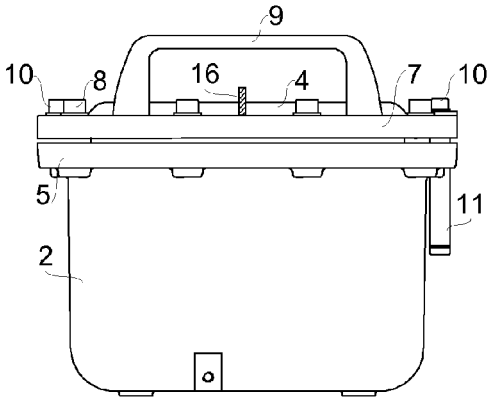
FIG. 1 shows a lateral view of the closed container.
Figure 2:
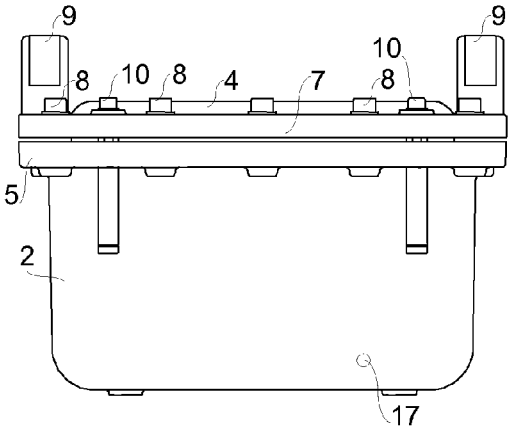
FIG. 2 shows a rear view of the container of FIG. 1.
Figure 3:
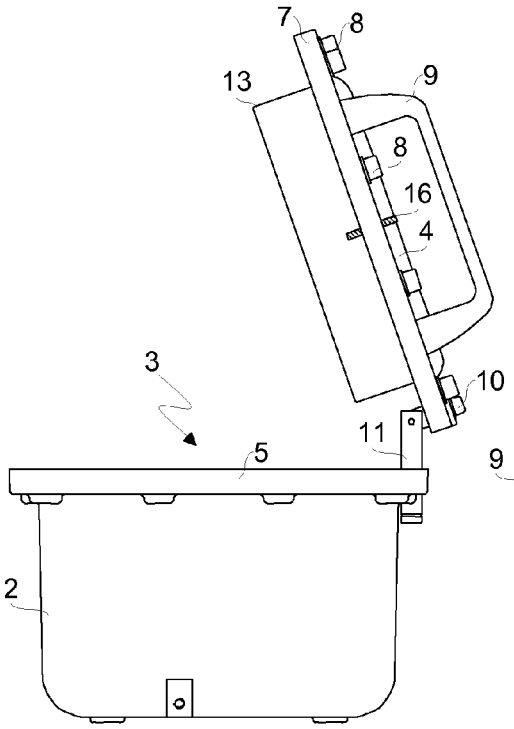
FIG. 3 shows a lateral view of the opened container.
Figure 4:
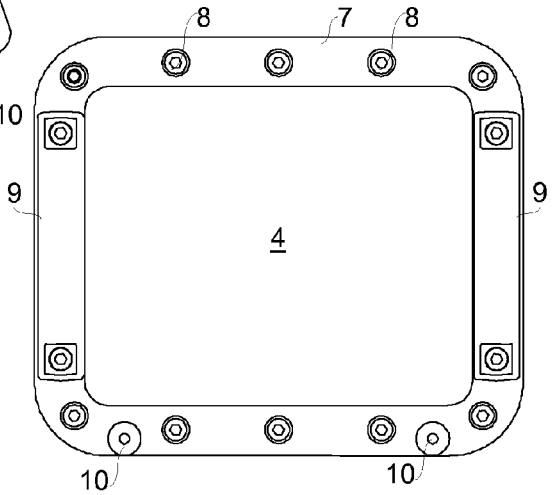
FIG. 4 shows a top view of the container of FIG. 1.
Figure 5:
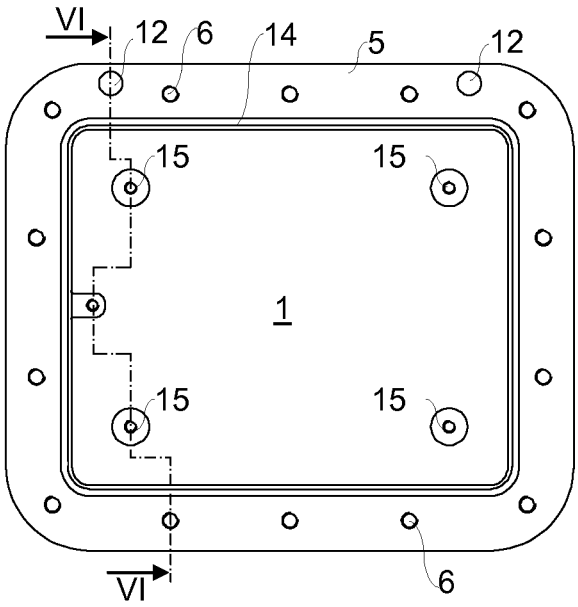
FIG. 5 shows a top view of the container without cover.
Figure 6:
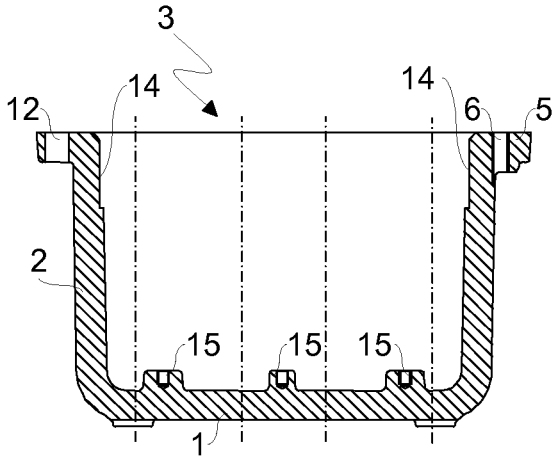
FIG. 6 shows section VI-VI of FIG. 5.

Referring to FIGS. 1 to 6, it is seen that the container according to the present invention comprises in a known way a base 1 and one or more side walls 2 joined to base 1, so as to define an upper opening 3 which can be closed by a cover 4.

At least one side wall 2 is flat and side walls 2 do not have portions with an undercut from upper opening 3 to base 1. In particular, base 1, side walls 2 and upper portion 3 are substantially rectangular with the rounded corners, so that the container has a substantially parallelepiped shape with the rounded edges. Upper opening 3 is surrounded by a first flange 5 provided with a plurality of first holes 6. Base 1, side walls 2 and first flange 5 are made of a single metal piece, in particular of aluminum or stainless steel, formed under low pressure or with another foundry technique. Cover 4 is provided with a second flange 7 provided with a plurality of second holes corresponding to first holes 6 of first flange 5 for fixing flanges 5, 7 by means of screws 8. Cover 4 is also provided with one or more handles 9. Cover 4 is preferably joined to the container by means of one or more hinges 10 which allow a rotating and translatory motion of cover 4 with respect to the container. In particular, hinges 10 comprise a pin 11 which can run in a hole 12 made in first flange 5, so that a user can lift and then rotate cover 4.

Cover 4 is further provided with a perimetric frame 13 suitable for penetrating into upper opening 3 and being coupled with the upper portion of the inner surfaces of side walls 2, in particular with a perimetric seat 14 made in the upper portion of side walls 2. The outer surface of perimetric frame 13 is perpendicular to the surface of second flange 7 suitable for being coupled with first flange 5. The inner surface of base 1 is provided with one or more threaded seats 15 for fastening electric and/or electronic devices.

Threaded extractors 16 are screwed in threaded holes crossing second flange 7, so that second flange 7 can be lifted from first flange 5 by screwing threaded extractors 16 against the upper surface of first flange 5. A side wall 2 is provided with an air valve 17 for balancing the pressure in the container during the closing or the opening of cover 4.

Possible modifications and/or additions may be made by those skilled in the art to the hereinabove disclosed and illustrated embodiment while remaining within the scope of the following claims.

The invention claimed is:

1. Container for dangerous environments, which comprises:

a base and one or more side walls extending from the base in an axial direction, so as to define an upper opening to be closed by a cover and surrounded by a first flange provided with a plurality of first holes, while the cover is provided with a second flange provided with a plurality of second holes corresponding to the first holes of the first flange, wherein the base, the side walls and the first flange are made of a single metal piece, wherein the cover is joined to the container by means of two or more hinges allowing a rotating and translatory movement of the cover with respect to the container, the cover being provided with a perimetric frame suitable for penetrating into the upper opening and for being coupled with an upper portion of the inner surfaces of the side walls, and wherein the two or more hinges each include a pin extending in the axial direction pivotably connected to the cover where the pin, positioned in a hole made in the first flange, is movable in the axial direction with the cover thereby allowing the rotating and translatory movement of the cover where the cover is movable in the axial direction away from the container allowing the cover to pivot substantially perpendicular to the axial direction in a backward manner about the two or more hinges at the same time.

2. Container according to claim 1, wherein the perimetric frame can be coupled with a perimetric seat made in the upper portion of the side walls.

3. Container according to claim 1, wherein the outer surface of the perimetric frame is perpendicular to the surface of the second flange suitable for being coupled with the first flange.

4. Container according to claim 1, wherein threaded extractors are screwed in threaded holes crossing the second flange, so that the second flange can be lifted from the first flange by screwing the threaded extractors against the upper surface of first flange.

5. Container according to claim 1, wherein a side wall is provided with an air valve for balancing the pressure in the container during the closing or the opening of the cover.

* * * * *